US009266661B2

(12) United States Patent
Krallmann

(10) Patent No.: US 9,266,661 B2
(45) Date of Patent: Feb. 23, 2016

(54) DISPENSER

(75) Inventor: Rainer Krallmann, Hiddenhausen (DE)

(73) Assignee: Krallmann Kunststoffverarbeitung GmbH, Hiddenhausen (DE)

( * ) Notice: Subject to any disclaimer, the term of this patent is extended or adjusted under 35 U.S.C. 154(b) by 44 days.

(21) Appl. No.: 14/117,044

(22) PCT Filed: May 23, 2012

(86) PCT No.: PCT/EP2012/002193
§ 371 (c)(1),
(2), (4) Date: Nov. 12, 2013

(87) PCT Pub. No.: WO2012/159747
PCT Pub. Date: Nov. 29, 2012

(65) Prior Publication Data

US 2015/0136812 A1 May 21, 2015

(30) Foreign Application Priority Data

May 26, 2011 (DE) ..... 10 2011 102 524

(51) Int. Cl.
*B65D 83/00* (2006.01)
*B05B 11/00* (2006.01)
*A47K 5/18* (2006.01)

(52) U.S. Cl.
CPC ..... *B65D 83/0005* (2013.01); *A47K 5/18* (2013.01); *B05B 11/0048* (2013.01); *B65D 83/0033* (2013.01)

(58) Field of Classification Search
CPC ..... A47K 5/18; B05B 11/0048; B05B 11/02; B65D 83/0005; B65D 83/0033
USPC ..... 222/209, 260, 386, 387–392
See application file for complete search history.

(56) References Cited

U.S. PATENT DOCUMENTS

| | | | | |
|---|---|---|---|---|
| 3,088,636 | A | 5/1963 | Spatz | |
| 3,268,123 | A * | 8/1966 | Spatz | 222/400.5 |
| 3,768,705 | A | 10/1973 | Spatz | |
| 3,870,200 | A * | 3/1975 | Spatz | 222/206 |
| 4,474,313 | A * | 10/1984 | Sieverding | 222/211 |
| 4,776,496 | A * | 10/1988 | Battegazzore | 222/209 |
| 4,978,037 | A | 12/1990 | Schuckmann | |
| 5,042,694 | A * | 8/1991 | Birmelin | 222/145.3 |
| 6,834,780 | B2 * | 12/2004 | Levy | 222/260 |

FOREIGN PATENT DOCUMENTS

| | | |
|---|---|---|
| DE | 32 26 835 | 1/1984 |
| DE | 37 16 821 | 12/1988 |
| DE | 203 15 111 | 3/2005 |
| EP | 1 533 247 | 5/2005 |
| FR | 2 516 482 | 5/1983 |

* cited by examiner

*Primary Examiner* — Nicholas J Weiss
(74) *Attorney, Agent, or Firm* — Paul Vincent

(57) ABSTRACT

A dispenser has a container and a spreading spring which is in engagement with the inner wall of the container and prevents movement of the sealing piston in a second direction which is opposed to the first direction. The spreading spring is made from synthetic material and has a central part from which a plurality of fingers arranged distributed over the periphery extend radially outwards. Each finger is connected to the central part in a manner articulated at its radially inner end and is in engagement at its radially outer end with the inner wall of the container. The central part and the fingers are constructed in one piece with one another and each finger is connected to the central part by way of a web, wherein in the region of the web a cutout is formed.

7 Claims, 6 Drawing Sheets

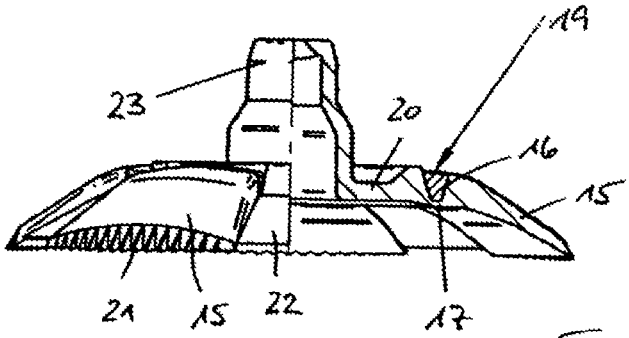
FIG. 10
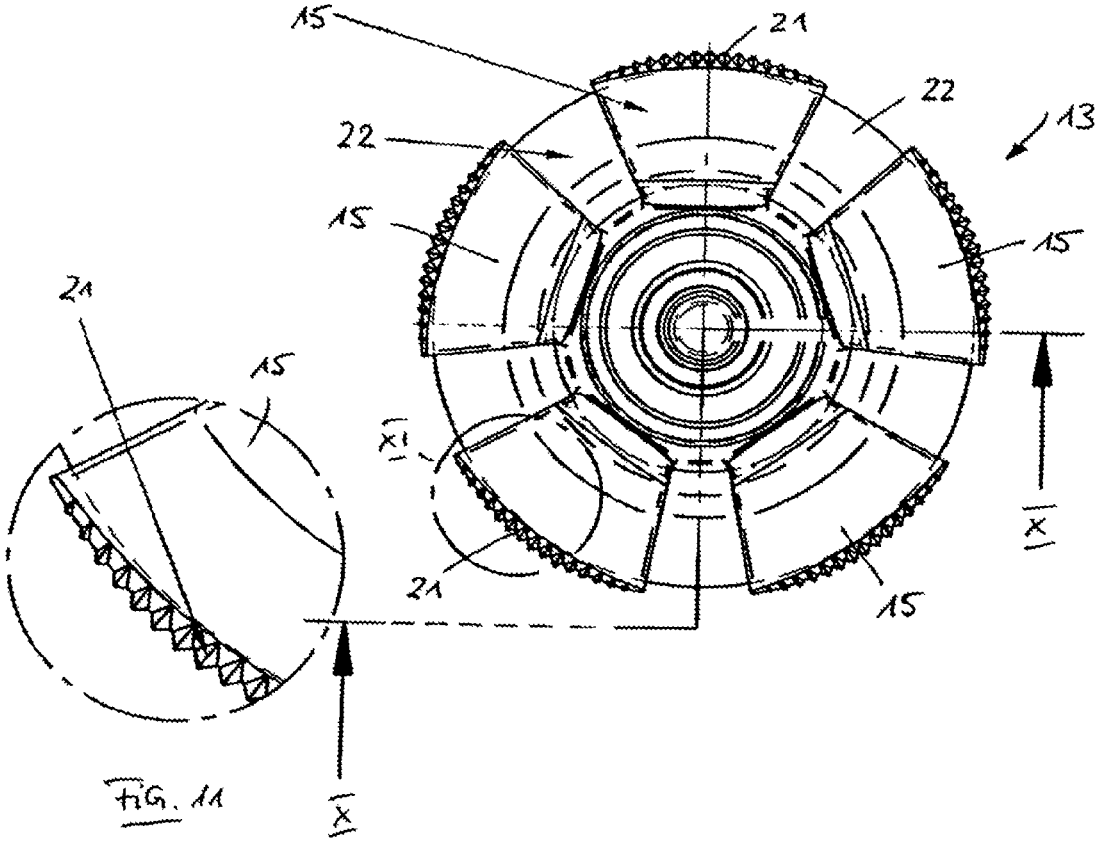
FIG. 11
FIG. 9

DISPENSER

This application is the national stage of PCT/EP2012/002193 filed on May 23, 2012 and also claims Paris Convention priority of DE 10 2011 102 524.7 filed May 26, 2011.

BACKGROUND OF THE INVENTION

The invention relates to a dispenser having a container whereof one end is sealed by a sealing piston which, in relation to the container, is adjustable in a first direction, wherein there is arranged, on the side of the sealing piston remote from a product chamber of the container, a spreading spring which is in engagement with the inner wall of the container and prevents movement of the sealing piston in a second direction which is opposed to the first direction.

A dispenser of this kind is also known, in connection with toothpaste, as a tube dispenser; however, the invention is not restricted to this but is also applicable to other viscous products or products to be metered using a dispenser.

However, in the text below a tube dispenser for toothpaste will be taken as the starting point, by way of example.

The dispenser has a container which is of cylindrical shape, conventionally based on a circle or based on an oval, and at the upper end whereof a pump-type removal device is constructed. The toothpaste is accommodated in the interior of the container, which forms a product chamber, and at the lower end of the container an axially displaceable sealing piston is inserted into it. On the side of the sealing piston remote from the product chamber there is seated a spreading spring which is connected to the closure piston and is supported against the inner wall of the container or is in engagement with this inner wall.

The toothpaste is conveyed outwards by expulsion, and when or after the removal device is deactivated a negative pressure is generated in the product chamber, on the basis whereof the sealing piston is displaced axially in the container by a small amount until the volume of the product chamber has been reduced enough for pressure to be equalized.

The purpose of the spreading spring is to prevent the sealing piston from being displaced in the opposing direction, that is to say in the direction of the lower end of the container. When the sealing piston is displaced as a result of the negative pressure prevailing in the product chamber, it draws the spreading spring with it, and the latter then comes briefly out of engagement, or into less engagement, with the inner wall of the container. As soon as movement of the piston has changed, the spreading spring abuts against the inner wall of the container again, as a result of its intrinsic elasticity.

The spreading spring takes the form of a metal part which has to be manufactured beforehand and then mounted on the sealing piston, which is conventionally made from synthetic material. This procedure is complex and cost-intensive.

There is also a risk that children or inattentive users will reach into the container from below and injure themselves on the spreading spring there. For this reason, a cover is conventionally provided by means of which the container is sealed at its lower end. The manufacture and subsequent mounting of this cover further increases the cost of the dispenser.

The object of the invention is to provide a dispenser of the type mentioned that can be manufactured simply and at low cost.

SUMMARY OF THE INVENTION

This object is achieved according to the invention by a dispenser having the features of the independent claim. Here, it is provided for the spreading spring to be made from synthetic material and to have a central part from which a plurality of fingers arranged distributed over the periphery extend radially outwards. Each finger is connected to the central part in a manner articulated at its radially inner end and is in engagement at its radially outer end with the inner wall of the container, wherein the central part and the fingers are constructed in one piece with one another and each finger is connected to the central part by way of a web, wherein in the region of the web a cutout is formed.

The fact that the spreading spring is made entirely from synthetic material makes it possible to manufacture it as a low-cost injection moulded part, and either to mount it on the sealing piston subsequently and in particular to latch it there, or even to construct the sealing piston and the spreading spring in one piece. The clamping force of the spreading spring is achieved by the elasticity of the fingers, and in the mounted condition these are in engagement with the inner wall of the container under radial pre-tension and thus ensure that the sealing piston can only be displaced in a first direction, towards the removal device, whereas it is prevented from movement in an opposing second direction, towards the lower end of the container, by the spreading spring.

The central part may for example be a sleeve, a hub or indeed a ring, wherein in each case the fingers are attached on the outside. According to the invention, it is provided for the central part and the fingers to be made in one piece with one another, in particular in a single injection moulding step.

In this case, each finger is connected to the central part by way of an integrally formed web which forms a hinge joint. The geometric dimensions of the web, which preferably takes the form of a thinning in the cross section by comparison with the cross section of the fingers, determine the deformability of the fingers in relation to the central part and indeed the clamping forces with which the fingers abut against the inner wall of the container.

In the region of the web there is made a cutout which is preferably filled with a filling material that acts as a restoring spring, wherein the filling material may be an elastomeric synthetic material. When the fingers are pivoted in relation to the central part, the filling material is compressed and exerts on the fingers, as a reaction force, a restoring force which can be used to clamp the spreading spring firmly in the container.

In a possible embodiment of the invention, it is provided for the fingers in each case to project freely from the central part and in this way to give the spreading spring the shape of a star. As an alternative, however, it may also be provided for respectively adjacent fingers to be connected to one another by way of a skin or membrane. This skin or membrane may also be made from an elastomeric synthetic material, and serves to form a complete cover.

At their radially outer end, the fingers abut against the inner wall of the container. In a possible embodiment of the invention, it is provided for the fingers to be retained or clamped by the frictional forces alone. However, better force transmission and an improved clamping action can be achieved if the fingers are constructed at their radially outer end in the form of a blade or are provided with radially protruding retaining claws.

Further details and features of the invention will be clear from the description of exemplary embodiments which follows and which is given with reference to the drawing, in which:

BRIEF DESCRIPTION OF THE DRAWING

FIG. 9 shows a plan view of a spreading spring according to a fourth exemplary embodiment, FIG. 10 shows the section X-X from FIG. 9, FIG. 11 shows the detail XI from FIG. 9.

DESCRIPTION OF THE PREFERRED EMBODIMENT

Figure 1:
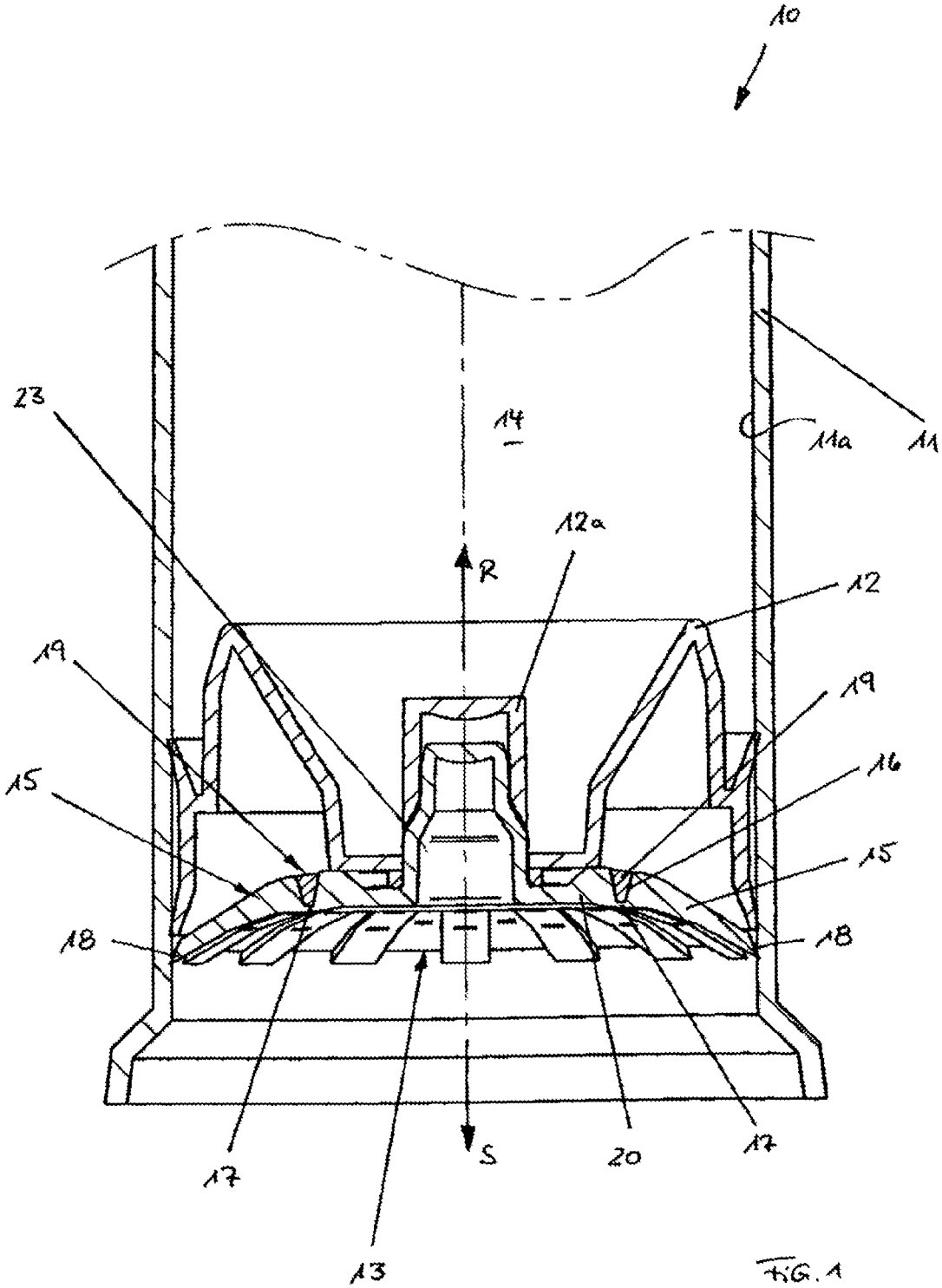
FIG. 1 shows a vertical section through the lower end of a dispenser.

FIG. 1 shows a section through a dispenser 10 having a housing 11 which is of cylindrical shape, based on a circle, and in which a product chamber 14 is formed for example for accommodating toothpaste. A sealing piston 12 is inserted into the container 11 from the lower end and abuts sealingly against the inner wall 11*a* of the container 11, preventing the product inside the product chamber 14 from being able to flow down out of the container 11.

On the side of the sealing piston 12 remote from the product chamber 14—the lower side as seen in FIG. 1—there is arranged a spreading spring 13 which has a hub-shaped central part 20 on which there is shaped an axial extension 23 which points in the longitudinal direction of the container 11 and is introduced into and fixed in a recess 12*a* in the sealing piston 12. The central part 20 carries a plurality of fingers 15 which are arranged distributed over the periphery and extend radially outwards from the central part such that they are inclined obliquely towards the lower end of the container 11—the end remote from the product chamber 14—and abut by means of their radially outer end with pre-tension against the inner wall 11*a* of the container 11 and are in engagement therewith.

Figure 3:
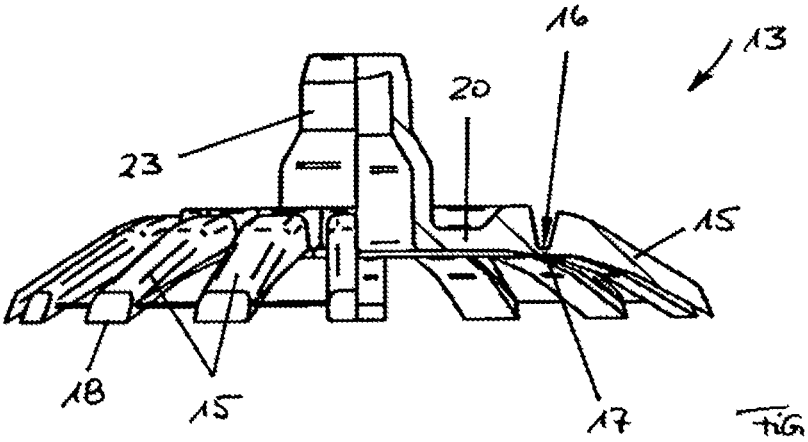
FIG. 3 shows the section III-III from FIG. 2.
Figure 2:
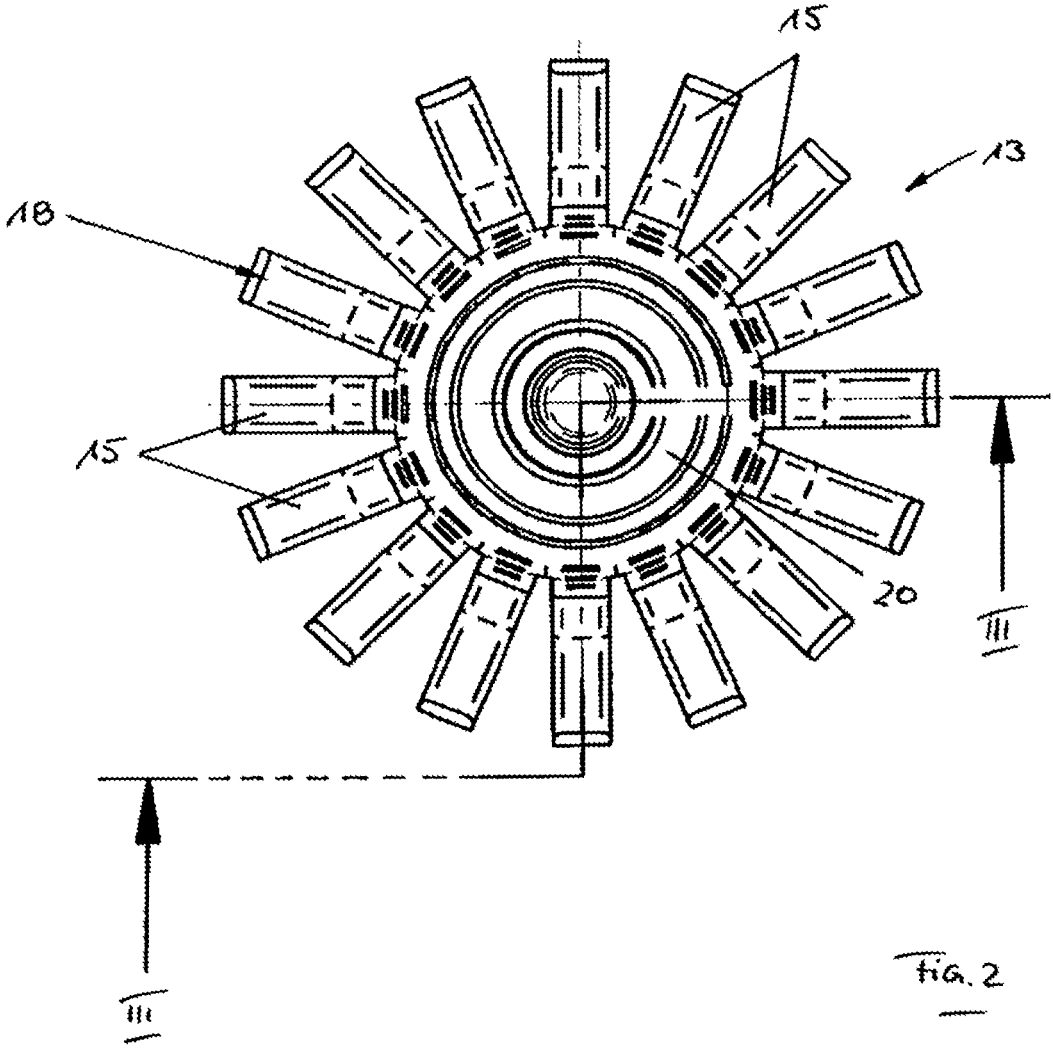
FIG. 2 shows a plan view of a spreading spring according to a first exemplary embodiment.

FIGS. 2 and 3 show just the spreading spring 13, according to a first embodiment. The central part 20, the extension 23 and the fingers 15 take the form of a one-piece synthetic part, wherein each finger 15 is attached at its radially inner end—the end facing the central part 20—in articulated manner to the central part 20 by way of a web 17 of thinner diameter, which forms a hinge joint. As a result of the thinning of the cross section in the region of the web 17, there is formed above the web, between the finger 15 and the central part 20, a cutout 16 which, according to the exemplary embodiment illustrated in FIGS. 2 and 3, is left free such that the deformability or spring action of the fingers 15 is determined substantially by the web 17.

As FIG. 3 in particular shows, the fingers 15 take the form of a blade at their radially outer end 18.

When a user has removed a desired quantity of product from the product chamber 14, a negative pressure is produced in the product chamber 14, and this negative pressure draws the sealing piston 12 in a first direction R, upwards as seen in FIG. 1. Because the sealing piston 14 is connected to the spreading spring 13, the spreading spring 13 is also drawn in the first direction R. During this, the fingers 15 deform and/or are pivoted in relation to the central part 20 and are drawn by means of their radially outer end over the inner wall 11*a* of the container 11. Once movement of the sealing piston 12 has ended, the fingers 15 abut against the inner wall 11*a* of the container 11 as a result of their intrinsic elasticity and are clamped against it. In this way, the spreading spring 13 prevents the piston from being able to yield in a second direction S which is opposed to the first direction R.

Figure 5:
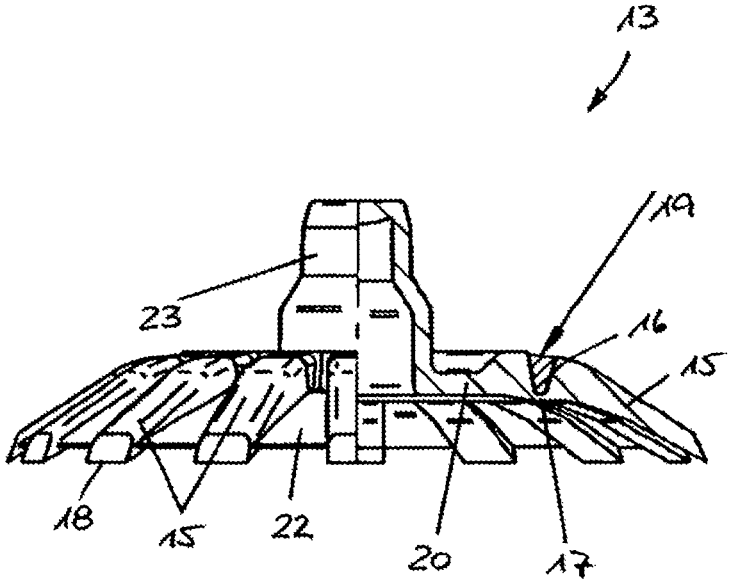
FIG. 5 shows the section V-V from FIG. 4.
Figure 4:
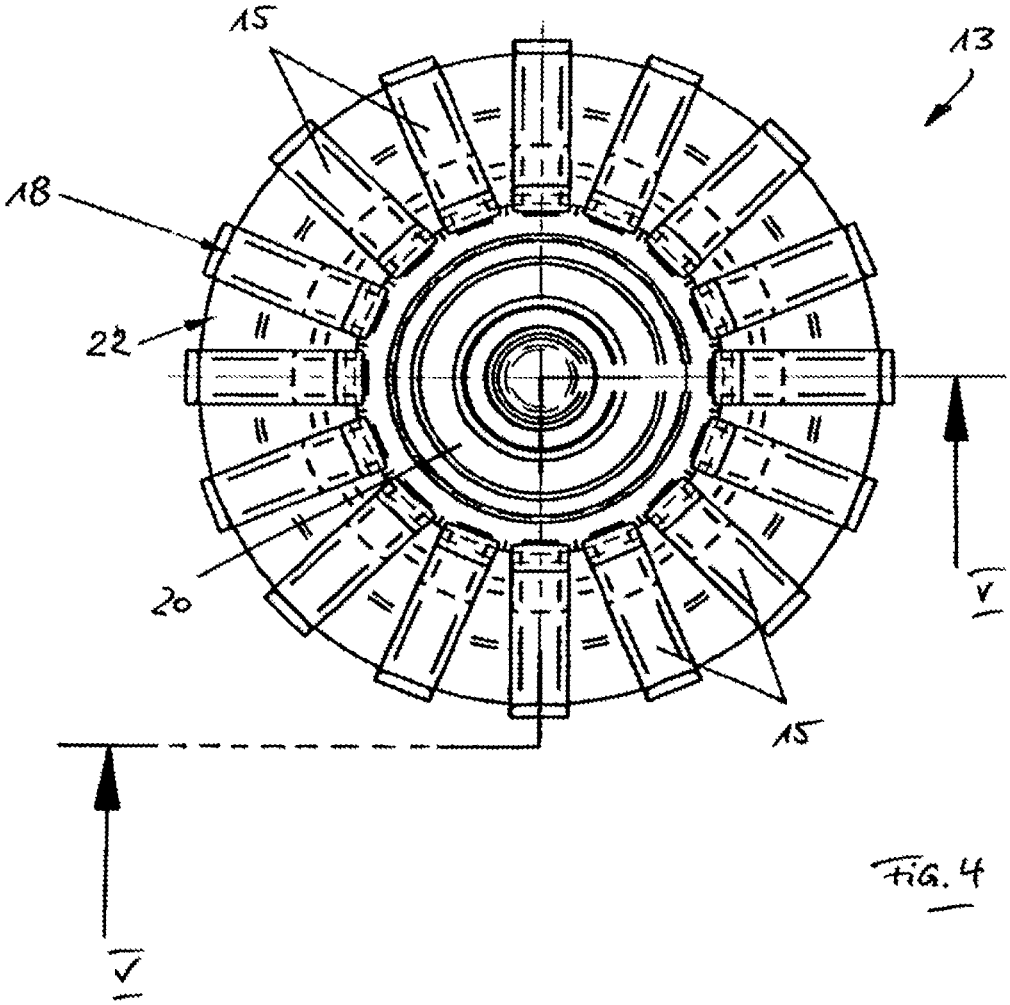
FIG. 4 shows a plan view of a spreading spring according to a second exemplary embodiment.

FIGS. 4 and 5 show a second exemplary embodiment of the spreading spring 13. The spreading spring 13 according to FIGS. 4 and 5 differs from the exemplary embodiment illustrated in FIGS. 2 and 3 substantially in that the cutout 16 formed above the web 17 is filled with a filling material 19 made from an elastic and preferably elastomeric synthetic material such that when the fingers 15 are deformed elevated restoring forces arise, and elevated spring forces can be applied to the fingers 15.

Moreover, in each case adjacent fingers 15 are connected to one another by way of a membrane 22 such that the spreading spring 13 takes the form of a screen and completely covers the underside of the sealing piston 12. The filling material 19 and/or the membrane may be made from an elastic and preferably elastomeric synthetic material, wherein the entire spreading spring 13 is made in a two-part injection moulding method in which first the central part 20 and the fingers 15 are injection moulded in a first method step, and then the filling material 19 and the membrane 22 are moulded on in a second method step.

Figure 7:
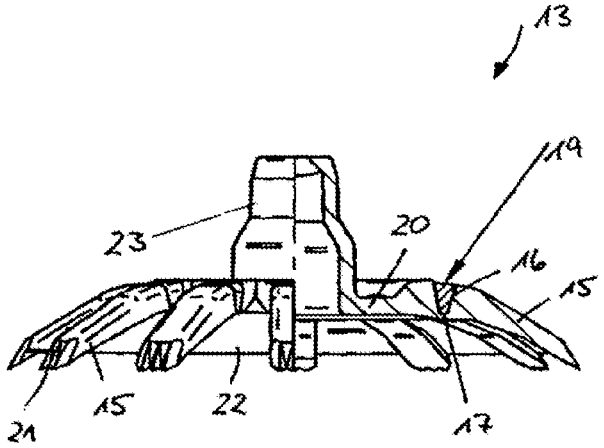
FIG. 7 shows the section VII-VII from FIG. 6.
Figure 8:
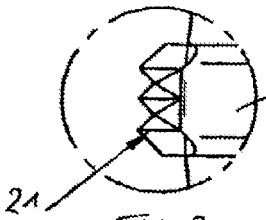
FIG. 8 shows the detail VIII from FIG. 6.
Figure 6:
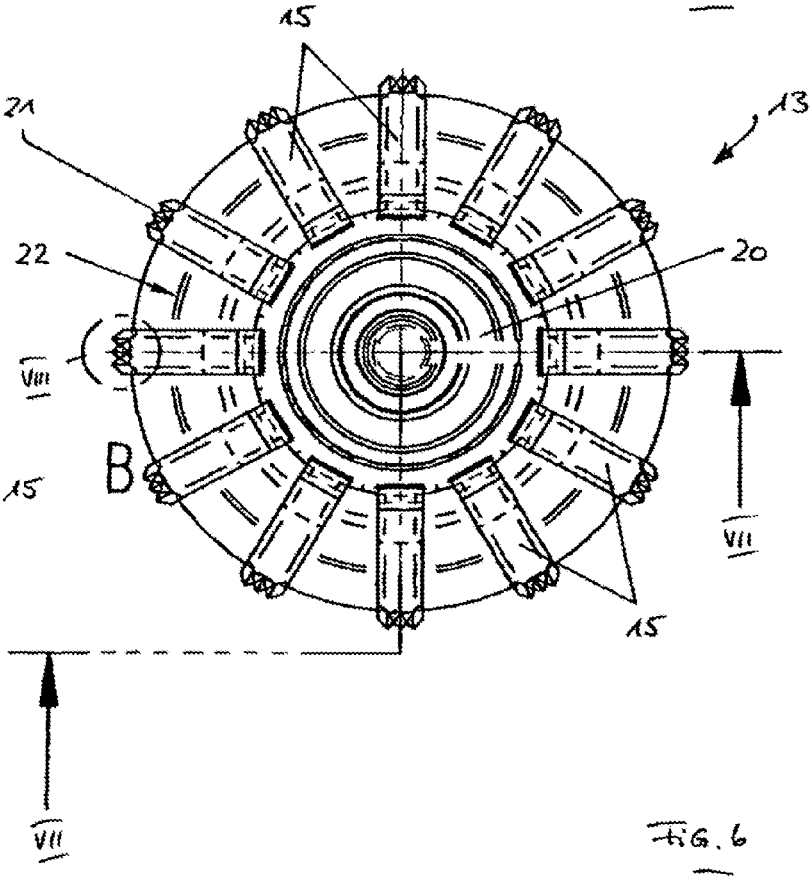
FIG. 6 shows a plan view of a spreading spring according to a third exemplary embodiment.

FIGS. 6, 7 and 8 show a third exemplary embodiment which forms a further development of the exemplary embodiment according to FIGS. 4 and 5. As shown in particular by FIG. 8, in this case it is provided for the fingers 15 to be constructed on their radially outer end in each case with sharp-edged retaining claws which can bring about a better engagement between the inner wall 11*a* of the container 11 and the fingers 15.

Whereas, in the exemplary embodiments described so far, twelve substantially rod-like fingers 15 are distributed over the periphery of the central part 20, FIGS. 9 to 11 show a fourth exemplary embodiment in which five plate-shaped fingers 15 arranged distributed over the periphery are provided and each have retaining claws 21 at their radially outer end, wherein the radial dimensions of the retaining claws 21 are larger in the central peripheral region of the fingers 15 than in the respective edge region of the fingers 15. This has the effect that the fingers 15 engage with the inner wall 11*a* of the container 11 with greater force in their central region.

Figure 13:
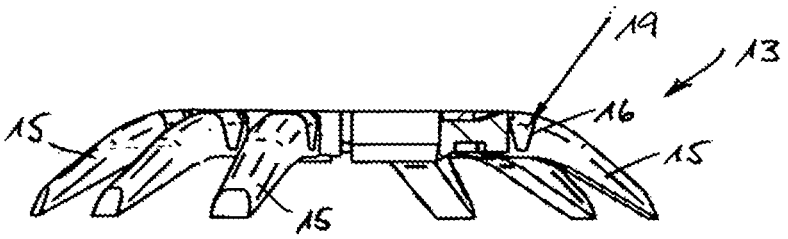
FIG. 13 shows the section XIII-XIII from FIG. 12.
Figure 12:
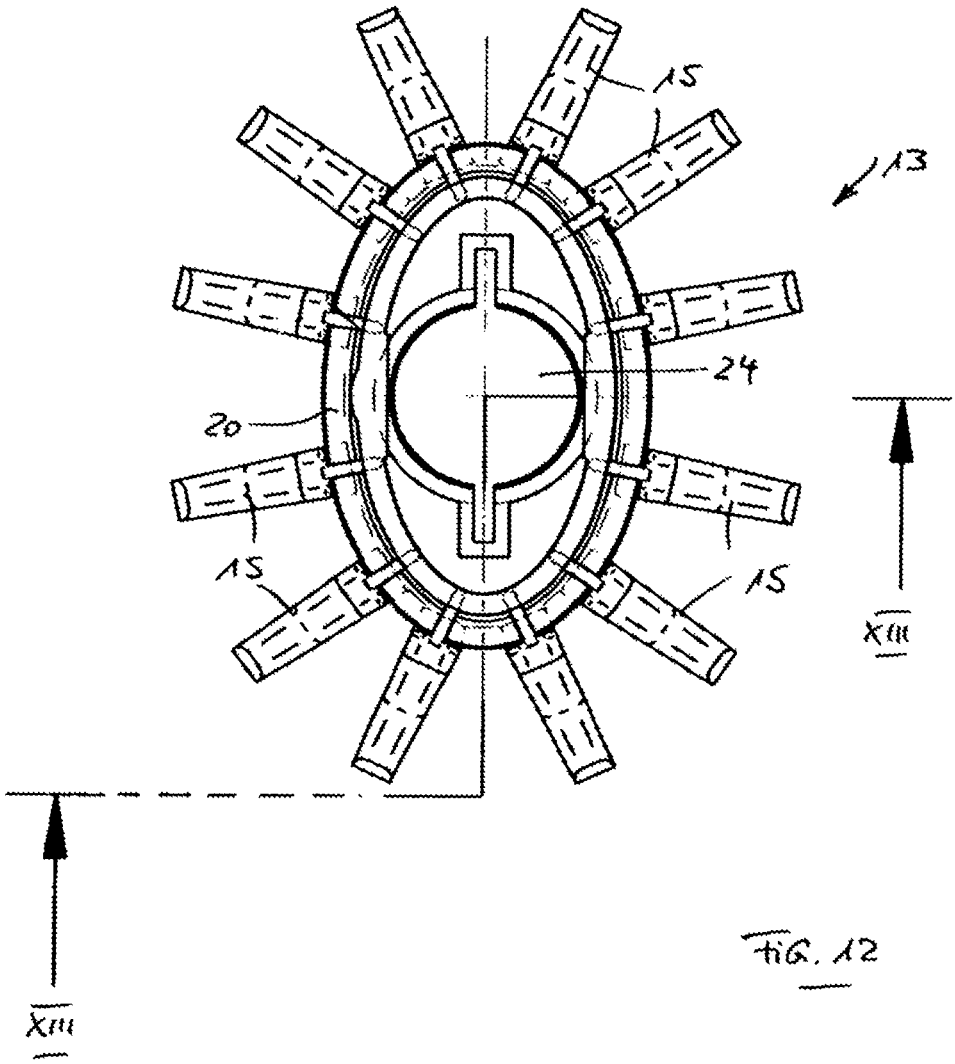
FIG. 12 shows a plan view of a spreading spring according to a fifth exemplary embodiment.

FIGS. 12 and 13 show a fifth exemplary embodiment of the spreading spring 13, wherein the central part 20 thereof now takes the form of an oval ring from which a plurality of fingers 15 extend such that they project freely radially outwards. Instead of a hub-shaped extension, there is constructed in the central part 20 an accommodation aperture 24 by means of which the spreading spring 13 may be attached to the sealing piston in a manner not illustrated.

In the exemplary embodiments illustrated, the sealing piston and the spreading spring each take the form of independent components which are connected to one another or secured to one another. However, it is also possible to construct the sealing piston and the spreading spring as a one-piece part.

I claim:

1. A dispenser, the dispenser comprising:

a container having an inner wall defining a product chamber;

a sealing piston, said sealing piston sealing one end of said container, wherein said sealing piston is structured for adjustment, relative to said container, in a first direction; and a spreading spring, said spreading spring disposed on a side of said sealing piston facing away from said product chamber, said spreading spring engaging said inner wall of said container to prevent movement of said sealing piston in a second direction which is opposed to said first direction, wherein said spreading spring is made from a synthetic material and has a central part from which a plurality of fingers are arranged, distributed over a periphery and extending radially outward, wherein each finger is connected to said central part in a hinged manner at radially inner ends of said fingers and radially outer ends of said fingers engage with said inner wall of said container, said central part and said fingers being constructed in one piece with one another and each finger is connected to said central part via a web, wherein a cutout is formed in a region of said web and a filling material that acts as a restoring spring is introduced into said cutout.

2. The dispenser of claim 1, wherein said filling material is a synthetic elastomeric material.

3. A dispenser, the dispenser comprising:

a container having an inner wall defining a product chamber;

a sealing piston, said sealing piston sealing one end of said container, wherein said sealing piston is structured for adjustment, relative to said container, in a first direction; and a spreading spring, said spreading spring disposed on a side of said sealing piston facing away from said product chamber, said spreading spring engaging said inner wall of said container to prevent movement of said sealing piston in a second direction which is opposed to said first direction, wherein said spreading spring is made from a synthetic material and has a central part from which a plurality of fingers are arranged, distributed over a periphery and extending radially outward, wherein each finger is connected to said central part in a hinged manner at radially inner ends of said fingers and radially outer ends of said fingers engage with said inner wall of said container, said central part and said fingers being constructed in one piece with one another and each finger is connected to said central part via a web, wherein a cutout is formed in a region of said web and adjacent fingers are connected to one another by way of a membrane.

4. The dispenser of claim 3, wherein said membrane is made from a synthetic elastomeric material.

5. The dispenser of claim 1, wherein said fingers are constructed at radially outer ends in a form of a blade.

6. The dispenser of claim 1, wherein said fingers are provided with retaining claws at radially outer ends thereof.

7. The dispenser of claim 1, wherein adjacent fingers are connected to one another by way of a membrane.

* * * * *